US006027513A

United States Patent [19]

Massana Florensa

[11] Patent Number: 6,027,513

[45] Date of Patent: Feb. 22, 2000

[54] WAX BAND FOR DEPILATION AND DEVICE FOR ITS USE

[75] Inventor: Josep Anton Massana Florensa, Torredembarra, Spain

[73] Assignee: Ceraboma, Inc., Torredembarra, Spain

[21] Appl. No.: 08/945,262

[22] PCT Filed: Feb. 20, 1997

[86] PCT No.: PCT/ES97/00040

§ 371 Date: Oct. 20, 1997

§ 102(e) Date: Oct. 20, 1997

[87] PCT Pub. No.: WO97/30608

PCT Pub. Date: Aug. 28, 1997

[51] Int. Cl.[7] ..... A61B 17/50

[52] U.S. Cl. ..... 606/134

[58] Field of Search ..... 606/134, 133, 606/131, 43, 1

[56] References Cited

U.S. PATENT DOCUMENTS

| | | | |
|---|---|---|---|
| 1,620,539 | 3/1927 | Gernsback . | |
| 2,425,696 | 8/1947 | Herrmann et al. | 606/134 |
| 2,954,324 | 9/1960 | Brummer | 606/134 |
| 3,808,637 | 5/1974 | Lapidus . | |
| 4,282,877 | 8/1981 | Mathews . | |
| 5,165,328 | 11/1992 | Erickson et al. | 99/330 |
| 5,733,824 | 3/1998 | Brunka et al. | 442/153 |

FOREIGN PATENT DOCUMENTS

| | | |
|---|---|---|
| 788269 | 10/1935 | France . |
| 1390484 | 6/1965 | France . |
| 2576495 | 8/1986 | France . |
| 9621419 | 7/1996 | WIPO . |

*Primary Examiner*—Michael Buiz
*Assistant Examiner*—Vy Q. Bui
*Attorney, Agent, or Firm*—Ostrolenk, Feber, Gerb & Soffen, LLP

[57] ABSTRACT

The invention relates to a wax band which presents a support strip (1) conformed by two sheets (3 and 4) interconnected in back-to-back relationship; the sheet (3) is made of plastic material and the sheet (4), on which is deposited a wax layer (2), is made of a cellulose web. For the application of said wax band, a heating device is used which is comprised of two bodies (5 and 6), hinged to each other. The body (5) houses a heating plate (12) provided with an electric resistance and a plate (14) on which are placed the wax bands to be heated. This invention applies to the fabrication of products and apparatuses intended to the aesthetics of the human body and more particularly to depilation.

15 Claims, 3 Drawing Sheets

WAX BAND FOR DEPILATION AND DEVICE FOR ITS USE

OBJECT OF THE INVENTION

This invention concerns a wax strip for depilation comprising a flexible supporting strip with one of its sides covered in a thin layer of wax. This strip needs preparation prior to use, involving a device in which the strip is heated until it reaches the correct consistency for application.

A preferable embodiment of this device comes in a case in the base of which there is a heating plate equipped with the corresponding electrical resistance and in the top there is a plate for positioning the strip to be heated.

FIELD OF THE INVENTION

This invention has applications in the manufacture of beauty products and equipment and more specifically for depilation.

BACKGROUND OF THE INVENTION

At present there are different elements and devices for depilation of humans. One of these elements consists of wax pastilles which are heated in a receptacle until the wax turns into a paste. It is applied while hot using a spatula or similar object on the area to be depilated and is removed when it has hardened, taking the unwanted hair with it. The need to heat the wax in a separate vessel is awkward and leaves the vessel smeared in wax and thus unsuitable for any other purpose.

Another element used for carrying out depilation comprises a supporting strip made up of a sheet of cellophane or PVC with a layer of wax on one of its sides. In order to apply the layer of wax to this type of supporting strip the wax has to be heated to a relatively high temperature, around 90° C. which can cause changes in the wax and loss of some of its characteristics.

Before beginning depilation, the wax strip must be heated and given that it is attached to the support both elements are subject to the same heating thus causing the support to lose consistency and stability. This variation in the physical characteristics of the support means that during depilation parts of the wax strip come away from the support and get stuck to the user's skin.

If the strip is applied at a lower temperature in order to prevent the wax pieces from coming away from the support, tale supporting strip becomes rather stiff making it difficult to adapt the strip to the areas to be waxed.

The obvious solution to this problem would be to use a support strip of such a type that its stability and properties are not affected by the changes in temperature which these strips undergo when they are being used or worked.

Other wax strips are known, such as the one covered by U.S. Pat. No. 1,620,539 which comprises a support made up of a fabric strip on which the wax is applied to both sides which are joined together via the holes or pores in the fabric. This wax strip prevents the wax from separating from the support as it is tightly bound to the fabric, but has the disadvantage that it requires a large quantity of wax which adds to final cost as only one of the sides is useable.

At present some electrical devices are also available for depilation amongst which the most important are those based on a kind of spiral which uses a vibrating movement to pluck out the hair. Although these devices are clean and easy to use they are not as efficient as waxing.

DESCRIPTION OF THE INVENTION

The strip of wax for depilation, which is the object of this invention, comprises a layer of wax applied to one of the sides of a supporting strip. The characteristics of this supporting strip are designed to achieve stability during heating of the wax and to ensure that the wax strip is fully attached to it regardless of the fact that the application of this layer is carried out at temperatures which are significantly lower than those used for traditional strips, which avoids the risk of changing the properties of the wax due to excessive heating.

This wax strip is highly flexible regardless of the temperature to which it is subjected, which it makes it easy to adapt to the surface to be waxed.

The supporting strip included in the wax strip comprises two different sheets which are joined together. According to a preferable embodiment, the lower layer consists of a plastic material preferably based on polyethylene and the upper layer which preferably, but not necessarily, has a higher thickness (slightly thicker than the lower layer) consists of cellulose microfibres, and viscose fibers. These two layers may be attached together by thermal welding using a bonding material based on resins by means of prior heating of the polyethylene layer or other adequate means.

The wax layer is applied to the exposed surface of the cellulose sheet at a temperature of around 60° C. which is much lower than the temperature used for conventional wax strips for applying wax on their respective supports.

At this temperature, around 60° C., the wax is applied to the surface of the cellulose sheet, and penetrates the cellulose microfibres making an efficient, secure bond of the wax layer to the support, preventing it coming away during depilation.

The supporting strip is highly flexible on the one hand due to the reduced thickness of the polyethylene strip which is significantly more flexible than PVC or cellophane as used in traditional strips, and also due to the use of the cellulose sheet which increases the thickness of the support and allows permanent binding of the wax layer to the supporting strip.

A preferable embodiment of a heating means for the heating of the wax impregnated strip before the depilation operation comprises a lower body or base and an upper body or cover which are joined together by means of hinges adopting a case-like structure.

In the lower body there is a heating plate with the corresponding electrical resistance. This plate is located centrally and lengthwise inside the above mentioned base and is supported on partitions supplied for this purpose in the base.

The resistance is connected to an electric cable which leaves the device and is terminated with a plug for connection to the mains or any other electrical supply. On the outside of the lower body base there is a groove for storing the cable when the device is not in use.

Inside the device there is a second plate which constitutes the support for the wax strip to be heated. This plate is placed on top of the heating plate and is held in place under pressure on the internal walls of the lower body of the device.

The underside of this supporting plate is equipped with feet and the upper side has a rear partition for supporting the wax strips to be heated, so that they do not become stuck to tie plate and can be picked up and taken out easily after they have been heated.

When the device is in use the cover or upper body of the case is in an open position revealing the supporting plates for the wax strips.

Finally, the heating plate has a housing for the corresponding electrical resistance.

DESCRIPTION OF THE DRAWINGS

To complement this description and in order to arrive at a better understanding of the characteristics of the invention a set of drawings is attached as an integral part of this description in which the following has been represented for illustration purposes only, with no limitation effects on the invention.

PREFERRED EMBODIMENT OF THE INVENTION

Figure 1:
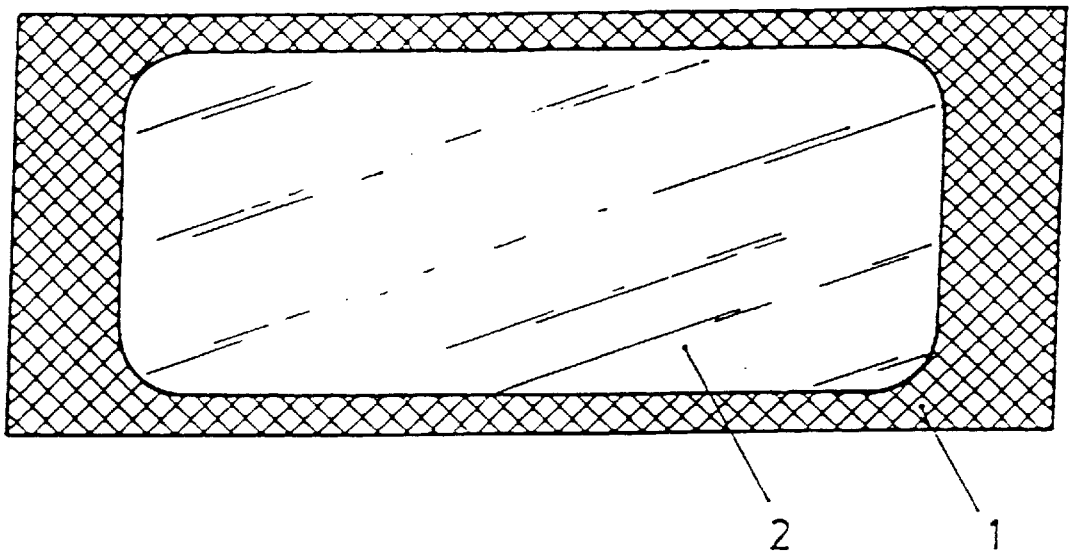
FIG. 1 shows a plan view of the wax strip for depilation which is the object of the invention.

From FIG. 1 it can seen how the suggested wax strip for depilation is made up of a supporting strip (1) on one of which surfaces a layer of wax (2) is applied.

Figure 2:
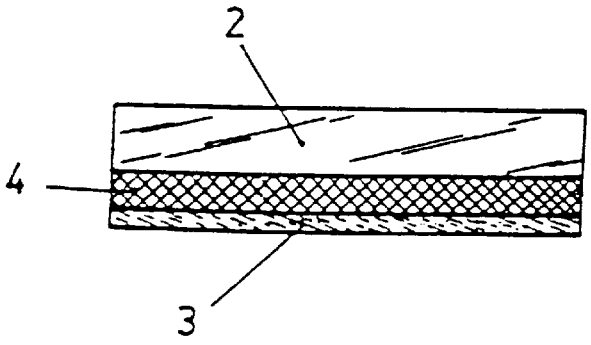
FIG. 2 shows a large scale cross-section of a part of the wax strip.

The supporting strip (1) is made up, as can be seen in FIG. 2, of two different sheets, specifically a lower sheet (3) made from polyethylene, and an upper sheet (4) made up of cellulose and viscose fibres bound together by a resin.

The sheet (4) of cellulose material is highly porous and on its free surface the wax layer (2) is applied which penetrates the pores of said sheet, the cellulose microfibres resulting embedded in the layer of wax (2).

Given the nature of the sheet (4) which is partially revealed around the wax layer (2) it has a significantly improved appearance and allows the strip to be held during application without touching the wax.

Figure 3:
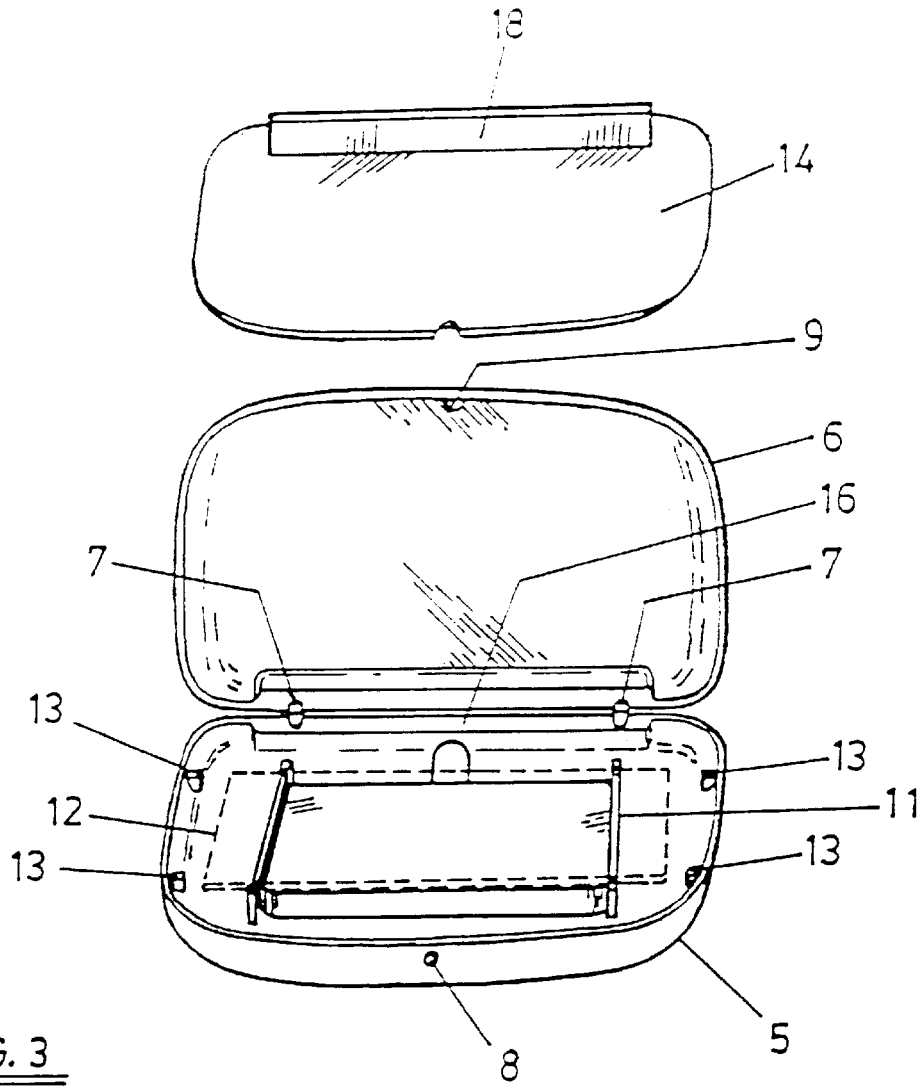
FIG. 3 shows a perspective view of the heating device for the wax strips in the open position. In this figure the heating device is shown by the dotted lines and the supporting plate for the wax strips is shown removed from the device and in a parallel position to that which it would occupy inside the device.

To carry out the depilation, the wax strip has to be heated as usual. A preferable embodiment for an adequate heating apparatus is shown in FIG. 3. This device comprises a lower body or base (5) and an upper body or cover (6) which are hinged (7) together at the back which allows the body (6) to be pivoted with respect to the body (5) to open or close the device.

Moreover the base (5) and the cover (6) have additional means of closure (8) and (9) to keep a stable position when the device is closed.

Figure 4:
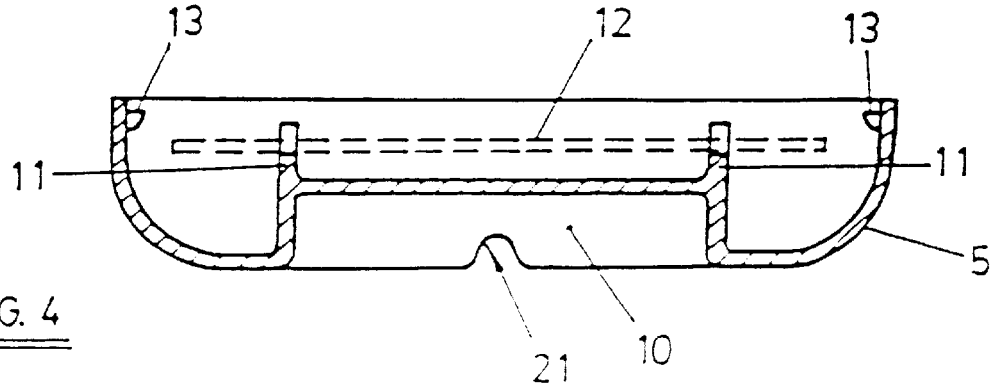
FIG. 4 shows a cross-section of the base body of the heating device cut lengthwise through a vertical plane in which the supporting plate is shown by dotted lines.
Figure 5:
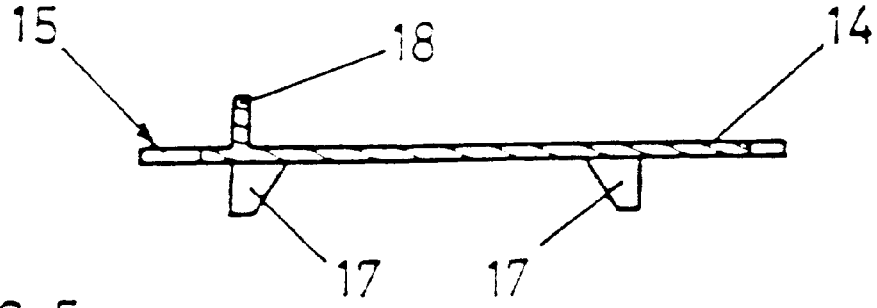
FIG. 5 shows a transverse section of the plate which constitutes the support for the wax strips to be heated.
Figure 6:
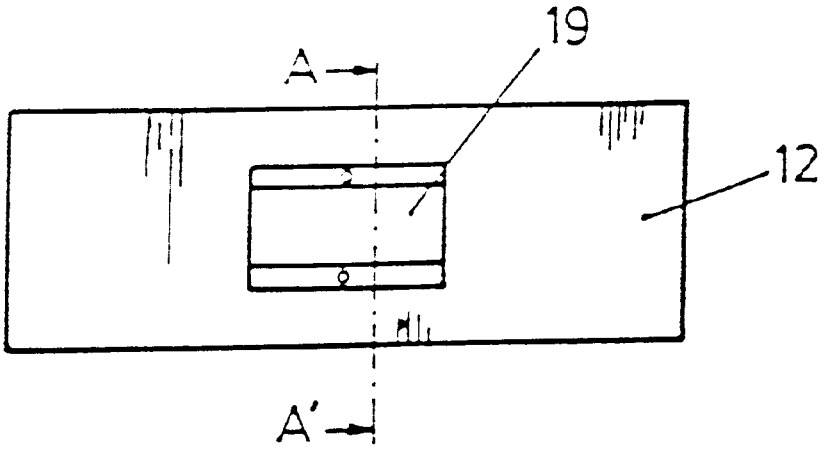
FIG. 6 shows a plan view of an example of the heating plate.

The body (5) comprises a receptacle with a groove (10) on the outside which will be explained later in detail with respect to FIG. 4. On the inside there are some partitions (11) which position and support the corresponding heating plate (12). This heating plate needs to be connected to an electrical supply by an electric cable. When the device is not in use this cable can be hidden away in the compartment provided by the groove (10).

The base (5) has supports (13) on the inside walls near to the upper lip for a plate (14) which must be fitted precisely or under pressure on the mouth or internal perimeter of the body of the base (5), and on top of the heating plate (12). This plate (14) acts as a means of support for the strips of wax to be heated.

The plate (14) is equipped on what may be considered as its rear edge with a cut-out (15) for its correct positioning on the rear internal part (16) of the base (5). The plate (14) is equipped with supporting feet (17) on its lower surface (see FIG. 7), and on the upper surface, close to the rear edge with a partition (18) which occupies practically the whole of its length. This partition (18) acts as the means of support for the strips of wax to be heated, which are inclined in order to assist with their removal when heated.

Figure 7:
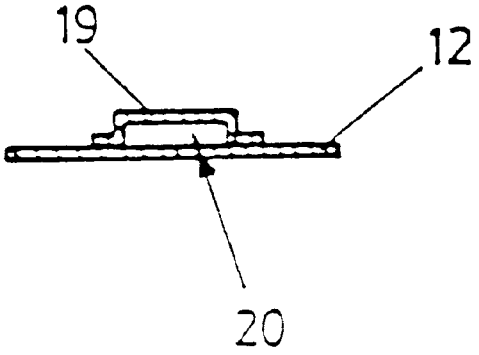
FIG. 7 shows a transverse section of the heating plate through the section A—A' indicated in the previous figure.

The heating plate (12), represented in FIG. 7 is equipped with a kind of bridge (19) which forms a housing (20) for the location of the corresponding electrical resistance.

Finally, the housing (10) which is found in the lower part of the base (5) is equipped with a cut-out (21) through which the electric cable is guided when it is extended to be connected to the mains or other suitable source of power.

It is not considered necessary to make this description any more detailed in order for any expert in the subject to understand the scope of the invention and the advantages which it offers.

The terms in which this report has been written should always be taken in the most general and non-limiting sense.

The materials, shape, size and arrangement of the elements will be subject to variation only if this does not involve an alteration of the essential characteristics of the invention, which are claimed below.

I claim:

1. A device for heating a depilation strip, the device comprising:

an upper body and a lower body, the two bodies being hinged together to define a case for enclosing the depilation strip during heating;

a heating plate disposed in the case;

a resistance element connected to the heating plate for converting an electrical energy to thermal energy which is transferred to the heating plate;

an electric power cable coupled to the resistance element for providing the electrical energy; and a support plate disposed in the case above the heating plate for supporting the wax strip to be heated on the support plate and off the heating plate.

2. The device according to claim 1, further comprising two portions disposed on an interior portion of the lower body, said portions supporting the heating plate.

3. The device according to claim 1, further comprising a plurality of peripheral supports formed on the interior portion of the lower body for seating the support plate, the support plate being disposed above the heating plate in the lower body.

4. The device according to claim 1, further comprising a means for fastening formed on external frontal portions of the lower and upper bodies.

5. The device according to claim 1, further comprising a groove formed on an outside portion of the lower body, the groove forming a compartment for housing and hiding the electric power cable when not in use.

6. The device according to claim 5, wherein the groove has a cut-out through which the cable can be passed from inside to outside the lower body to connect to a power supply.

7. A device, according to claim 1, further comprising a bridge piece formed on the heating plate the bridge defining a housing for the resistance element.

8. The device according to claim 1, further comprising a partition formed on the support plate for maintaining a position of the depilation strip on the support plate during heating.

9. The device according to claim 1, further comprising supporting feet formed on a lower portion of the support plate.

10. The device according to claim 1, wherein the support plate is sized and shaped to fit precisely within the inside perimeter of the case.

11. The device according to claim 1, wherein the support plate is sized and shaped to be press-fitted within the inside perimeter of the case.

12. The device according to claim 1, wherein the support plate is removably disposed in the case.

13. A flexible depilation strip, comprising:

a first support sheet made from polyethylene;

a second support sheet made from cellulose and viscose microfibers adhered together with a resin based binding agent, the second support sheet being superimposed over and adhered to the first support sheet; and a wax layer deposited on and partially impregnating the second support sheet.

14. The depilation strip according to claim 13, wherein the upper sheet has a greater thickness than the lower sheet and the two sheets are attached together by thermal welding using a resin-based binding agent, the polyethylene sheet being submitted to previous heating.

15. The flexible depilation strip as recited in claim 13, wherein the second support sheet has a major surface and the wax layer is deposited on only a first portion of the major surface of the second support sheet so as to leave a second portion of the major surface exposed around the periphery of the wax layer.

* * * * *